United States Patent [19]

Demarest, Jr.

[11] Patent Number: 4,742,922

[45] Date of Patent: May 10, 1988

[54] BOOK RACK OF SELECTIVE CAPACITY

[76] Inventor: Russell G. Demarest, Jr., 60 Forest Rd., Glen Rock, N.J. 07452

[21] Appl. No.: 43,767

[22] Filed: Apr. 29, 1987

[51] Int. Cl.[4] ..... A47B 65/00

[52] U.S. Cl. ..... 211/43; 211/175

[58] Field of Search ..... 211/43, 42, 41, 175, 211/184, 72, 85, 40, 132, 195, 208; 248/149, 152, 448

[56] References Cited

U.S. PATENT DOCUMENTS

| | | | |
|---|---|---|---|
| 633,416 | 9/1899 | Beaulieu | 211/41 |
| 1,266,776 | 5/1918 | Dietzel | 211/43 X |
| 1,750,575 | 3/1930 | Cubberley | 211/43 X |
| 2,134,606 | 10/1938 | Hackworth et al. | 211/43 X |
| 4,496,127 | 1/1985 | Nelson | 211/43 X |
| 4,560,073 | 12/1985 | King | 211/43 X |

*Primary Examiner*—Ramon S. Britts
*Assistant Examiner*—Sarah A. Lechok Eley
*Attorney, Agent, or Firm*—Samuelson & Jacob

[57] ABSTRACT

A book rack of selective capacity includes end members and a base extending longitudinally between the end members, the base having an undulate configuration including undular support members and an undular basal member, the undulations being in a flexible conformable material such that the length of the base may be expanded and contracted selectively into conformance with a particular longitudinal length by bending of the undulations, thereby providing a longitudinal spacing between the end members corresponding to the desired capacity of the book rack.

19 Claims, 2 Drawing Sheets

BOOK RACK OF SELECTIVE CAPACITY

BACKGROUND OF THE INVENTION

The present invention relates generally to racks for holding books and like items and pertains, more specifically, to book racks of the type in which the end retaining members are movable to selected positions relative to one another to vary the capacity of the book rack.

Book racks have been made available over the years in a very wide variety of styles and configurations and have been adapted for use in connection with books of different dimensions, as well as with other items, such as magazines, phonograph records, photographs, games and the like. Many of these book racks have been constructed to enable relative movement between the end retaining members so that the end retaining members will serve to hold the books essentially upright in the rack, despite changes in the number or thickness of the books supported in the rack.

The present invention provides an improvement in the construction of book racks of the type having a selectively variable capacity, the improvement having several objects and advantages, some of which may be summarized as follows: Ready placement on a desk top, table top or a similar surface in a configuration having a selected capacity for holding books and like items essentially upright for easy access at that surface; ease of selection of the capacity of the book rack and retention of the selected capacity without the need for special tools or intricate adjustments; simplicity in design and construction for economical manufacture and widespread use; rugged and strong construction coupled with foolproof operation for trouble-free performance over an extended service life; and an aesthetically pleasing as well as an ergonomically correct design.

SUMMARY OF THE INVENTION

The above objects and advantages, as well as further objects and advantages, are attained by the present invention which may be described briefly as a book rack of selective capacity, the book rack comprising: opposed end members spaced apart from one another longitudinally to define the capacity between the end members; and a base having a length extending longitudinally between the opposed end members, the base including a plurality of flexible undulations of conformable material, the undulations extending transverse to the longitudinal length of the base to enable selective longitudinal expansion and contraction of the length of the base by bending of the flexible undulations into conformance with a selected length corresponding to a selected capacity between the end members for selectively varying the longitudinal spacing between the end members to adjust the capacity of the book rack.

BRIEF DESCRIPTION OF THE DRAWING

The invention will be understood more fully, while still further objects and advantages will become apparent, in the following detailed description of a preferred embodiment of the invention illustrated in the accompanying drawing, in which.

DESCRIPTION OF THE PREFERRED EMBODIMENT

Figure 1:
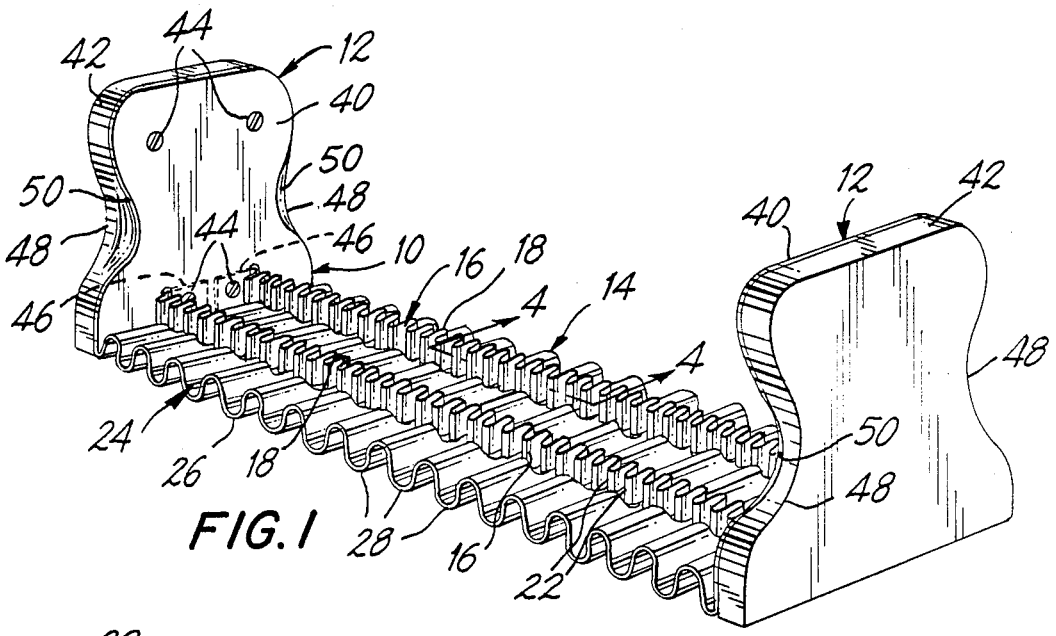
FIG. 1 is a perspective view of a book rack constructed in accordance with the present invention.

Referring now to the drawing, and especially to FIG. 1 thereof, a book rack constructed in accordance with the invention is shown at 10. Book rack 10 includes end retaining members shown in the form of vertically upstanding opposite end assemblies 12 spaced apart horizontally from one another, and a base assembly 14 extending longitudinally between the end assemblies 12. The base assembly 14 includes a plurality of book supports, here shown in the form of two support members 16 extending longitudinally between the end assemblies 12 and having upper edges 18 which lie in a common horizontal support plane 20 (see FIG. 2) upon which books, or similar items, are to be supported in an upright position between the end assemblies 12. Support members 16 are constructed of a flexible, conformable material having a plurality of undulations 22 extending transverse to the longitudinal direction, in this instance upwardly, or altitudinally, along each support member 16, and the undulations 22 have a cross-sectional configuration such that the support members 16 selectively may be expanded or contracted longitudinally to select any desired longitudinal spacing between end assemblies 12, within the limits of the dimensions of the base assembly 14, the conformable characteristics of the material of the support members 16 enabling the selected spacing to remain as selected, as will be described more fully below.

Support members 16 themselves are supported and held in place laterally by a base member 24 having a generally horizontal basal portion 26 extending longitudinally between the end assemblies 12 and including a plurality of undulations 28 extending transverse to the longitudinal direction, here shown laterally across the basal portion 26. Base member 24 also is constructed of a flexible, conformable material and the undulations 28 have a cross-sectional configuration such that the basal portion 26 selectively may be expanded or contracted longitudinally, along with the support members 16 to select the desired longitudinal spacing between end assemblies 12, the conformable characteristics of the material of basal portion 26 enabling the selected spacing to remain as selected, as will be described below.

Figure 2:
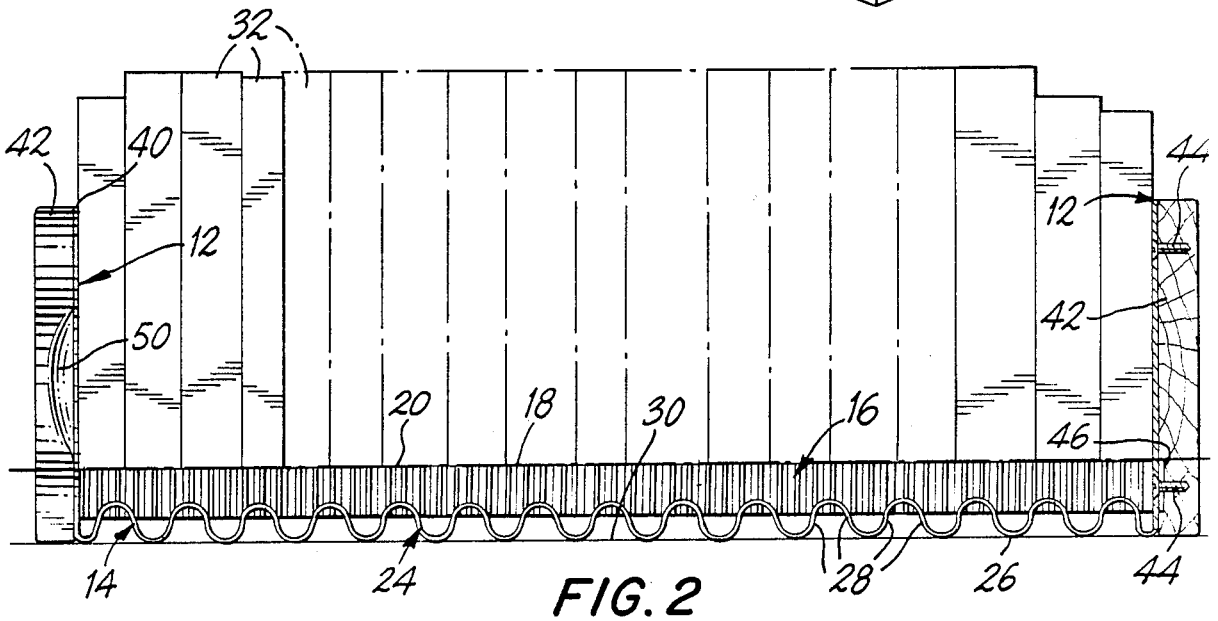
FIG. 2 is a front elevational view of the book rack in a lengthened configuration.
Figure 3:
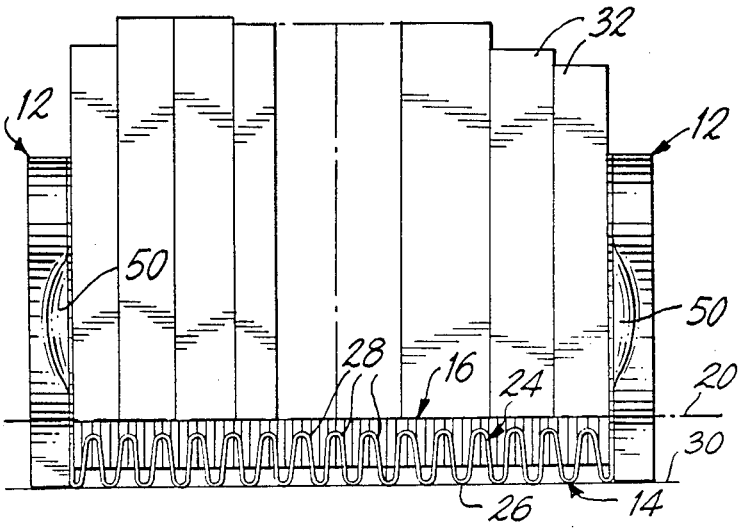
FIG. 3 is a front elevational view of the book rack in a shortened configuration.
Figure 4:
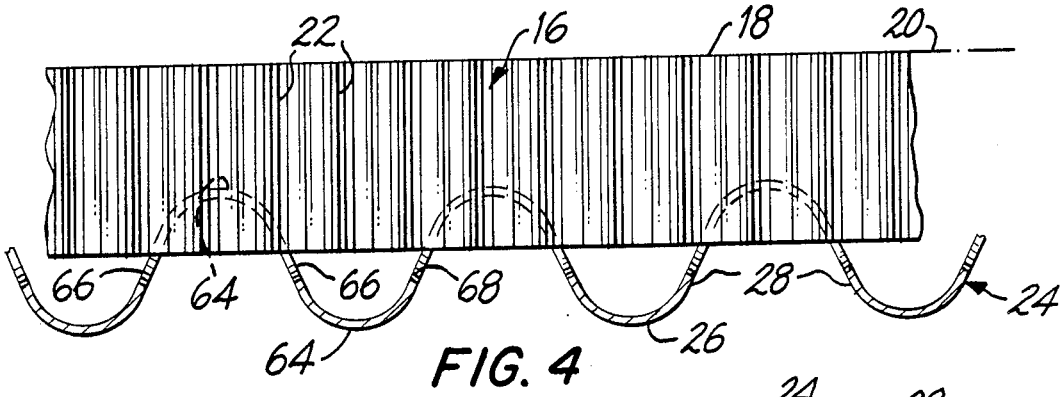
FIG. 4 is an enlarged fragmentary view of a portion of FIG. 2.
Figure 5:
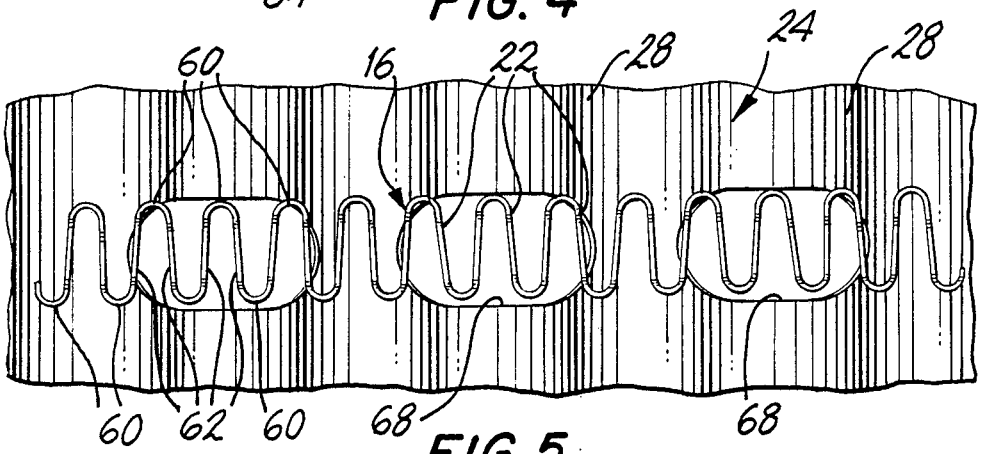
FIG. 5 is a top plan view of the fragment of FIG. 4.
Figure 6:
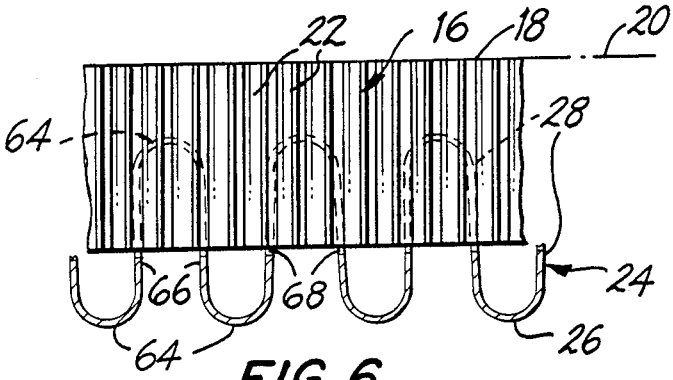
FIG. 6 is an enlarged fragmentary view of a portion of FIG. 3.
Figure 7:
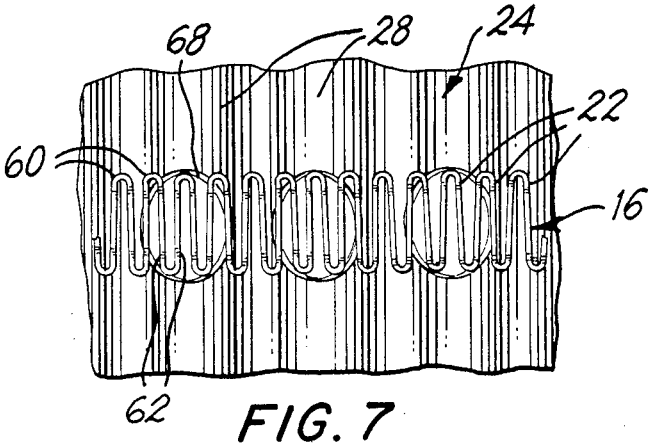
FIG. 7 is a top plan view of the fragment of FIG. 6.

Thus, as seen in FIGS. 2 and 3, book rack 10 is placed upon a horizontal surface 30, such as a desk top, table top or the like, with the basal portion 26 of base member 24 of base assembly 14 resting against the horizontal surface 30. In FIG. 2, the basal portion 26 and support member 16 have been stretched horizontally to increase the length of base assembly 14 and the longitudinal spacing between end assemblies 12 to accommodate a number of books 32 to be held in the book rack 10 and supported in a vertically upright position between the end assemblies 12. In order to accommodate the elongation and expansion of support members 16 and basal portion 26, the undulations 22 and 28 have been flexed to conform the support members 16 and the basal portion 26 to the selected length of base assembly 14. The conformable nature of the material of the undulations 22 and 28, and support members 16 and basal portion 26, enables the support members 16 and basal portion 26 and, consequently, base assembly 14, to remain at the selected length, in self-sustaining conformance to that length until such time as another length is selected. In FIG. 3, the longitudinal spacing between end assemblies 12 has been decreased, by compressing and contracting the base assembly 14, and support members 16 and basal portion 26 thereof, to accommodate a lesser number of books 32 than shown in FIG. 2. Again, the undulations 22 and 28 have been flexed and the conformable nature of the material of the undulations 22 and 28 assures that the selected shortened length of base assembly 14, and support members 16 and basal portion 26, will be retained in self sustaining conformance to the shortened length.

The preferred material for support members 16 and basal portion 26 is a metal which will retain the configuration into which it is flexed. One such material is a softer alloy of aluminum which can be formed into the undulate configuration of support member 16 and basal portion 26 and can be flexed to bend the undulations 22 and 28 for enabling the selected elongation and contraction of support member 16 and basal portion 26. Other suitable materials, such as some synthetic resins, will become apparent to those skilled in the art of materials.

In the preferred embodiment, base member 24 includes end portions 40 which are unitary with basal portion 26 and extend vertically upwardly at the opposite ends of basal portion 26. For aesthetic considerations, as well as for ergonomic purposes, end portions 40 are secured to corresponding end blocks 42, as by fasteners shown in the form of screws 44, to establish the end assemblies 12. Support members 16 include end tabs 46 which also are secured to end blocks 42 by means of some of the screws 44. End blocks 42 may be constructed of wood, a molded synthetic resin, or another essentially equivalent material, which will provide an aesthetically pleasing appearance, while at the same time supplying reinforcement for the end portions 40. The end portions 40 and the end blocks 42 are contoured along the side edges 48 of the respective assembled end portions 40 and end blocks 42 to establish handgrip contours 50 which facilitate gripping of the end assemblies 12 for selective expansion and contraction of the base assembly 14 and book rack 10.

Turning now to FIGS. 4 through 7, as well as to FIGS. 1 through 3, the cross-sectional configuration and the number of undulations 22 in each support member 16 is such that within the range of elongation of the base assembly 14 each undulation 22 is not subjected to a very large amount of longitudinal flexure and bending. Thus, each crest 60 of each undulation 22 has a radius large enough to assure that the deviation of the flanks 62 from the lateral direction is held to a minimum. In this manner, bending of the material of undulations 22 is reduced. At the same time, the undulations serve as vertical columns providing sturdy support for books 32, and the rigidity of the columns is maintained by limiting the stretching out of the individual undulations 22.

The cross-sectional configuration of undulations 28 of base member 24 also includes larger radius crests 64 between flanks 66, and the number of undulations 28 is great enough to reduce the amount of bending required in each undulation 28. However, since rigidity in the direction along the undulations 28 is not as critical as in undulations 22, it is not necessary to include as large a number of undulations 28 as the number of undulations 22. The number of undulations 28 need merely be sufficient to enable the combination of base member 24 and support members 16, within the base assembly 14, to exhibit the desired support strength for the number of books to be supported in any selected length of the book rack 10.

Base member 24 also serves to confine support members 16 against lateral displacement during adjustment and use of book rack 10. Thus, each undulation 28 of base member 24 includes an aperture 68 having a lateral width complementary to the lateral width of undulations 22 of support members 16. Apertures 68 are aligned longitudinally coextensive with support members 16 so as to form restraining guide channels within which the support members 16 are confined against unwanted lateral movement. The support members 16 and base member 24 thus are integrated into a complete base assembly 14 which remains sturdy throughout the range of adjustment of the longitudinal spacing between end assemblies 12.

It will be noted that the upper edges 18 of the support members 16 remain within support plane 20 during expansion and contraction of the base assembly 14. Thus, especially upon contraction, there is no tendency for the supported portions of the books 32 to be damaged by engagement with any sharp edges or other abutments which might otherwise be present in prior devices, such as telescoping elements, currently in use in book racks designed for selective capacity. Additionally, the aforesaid construction enables smooth expansion and contraction without interference from the supported portions of the books.

It will be seen that book rack 10 provides for the selective adjustment of the capacity of the rack in a simple, highly effective manner. Adjustment is attained merely by grasping the end assemblies 12 and moving the end assemblies toward or away from one another until the desired length is reached. Once the length is adjusted, no further manipulation is required to maintain the selected length.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows.

1. A book rack of selective capacity, said book rack comprising:

opposed upstanding end members spaced apart from one another longitudinally to define the capacity between the end members; and a base having an unbroken length extending longitudinally from one to the other of the opposed end members and attached thereto, the base including a plurality of flexible undulations of self-sustaining conformable material, said undulations extending transverse to the longitudinal length of the base and comprising means for enabling selective longitudinal expansion and contraction of the length of the base by bending of the flexible undulations into self-sustaining conformance with a selected length corresponding to a selected capacity between the end members for selectively varying the longitudinal spacing between the end members to adjust the capacity of the book rack.

2. A book rack of selective capacity, said book rack comprising:

opposed end members spaced apart from one another longitudinally to define the capacity between the end members; and a base having a length extending longitudinally between the opposed end members, the base including a plurality of flexible undulations of conformable material, said undulations extending transverse to the longitudinal length of the base to enable selective longitudinal expansion and contraction of the length of the base by bending of the flexible undulations into conformance with a selected length corresponding to a selected capacity between the end members for selectively varying the longitudinal spacing between the end members to adjust the capacity of the book rack;

the base including at least a pair of support members extending longitudinally between the end members, and the flexible undulations including undulations extending altitudinally across the longitudinal extent of the support members.

3. The invention of claim 2 wherein the support members include upper support edges lying within a common support plane.

4. A book rack of selective capacity, said book rack comprising:

opposed end members spaced apart from one another longitudinally to define the capacity between the end members; and a base having a length extending longitudinally between the opposed end members, the base including a plurality of flexible undulations of conformable material, said undulations extending transverse to the longitudinal length of the base to enable selective longitudinal expansion and contraction of the length of the base by bending of the flexible undulations into conformance with a selected length corresponding to a selected capacity between the end members for selectively varying the longitudinal spacing between the end members to adjust the capacity of the book rack;

the base including a basal member extening longitudinally between the end members, and the flexible undulations including undulations extending laterally across the longitudinal extent of the basal member.

5. The invention of claim 4 wherein the base includes at least a pair of support members extending longitudinally between the end members, and the flexible undulations include undulations extending altitudinally across the longitudinal extent of the support members.

6. The invention of claim 5 wherein the support members include upper support edges lying within a common support plane.

7. The invention of claim 5 including restraining means on the basal member for confining the support members to generally longitudinal alignment along the basal member.

8. The invention of claim 7 wherein the restraining means includes apertures in the undulations of the basal member for receiving the support members therein.

9. The invention of claim 8 wherein the support members include upper support edges lying within a common support plane.

10. The invention of claim 9 wherein the conformable material is an aluminum alloy.

11. The invention of claim 5 wherein the undulaundulations in the support members include crests, and flanks interconnecting the crests, the crests having a radius of curvature large enough to maintain the flanks in generally lateral orientation throughout the range of expansion and contraction of the length of the support members.

12. The invention of claim 11 wherein the number of undulations in each of the support members is greater than the number of undulations in the basal member.

13. The invention of claim 12 wherein the support members include upper support edges lying within a common support plane.

14. The invention of claim 13 wherein the end members each include contoured recesses providing handgrips for manipulating the end members during expansion and contraction of the length of the base.

15. The invention of claim 14 wherein the conformable material is an aluminum alloy.

16. The invention of claim 12 including restraining means on the basal member for confining the support members to generally longitudinal alignment along the basal member.

17. The invention of claim 16 wherein the restraining means includes apertures in the undulations of the basal member for receiving the support members therein.

18. The invention of claim 17 wherein the support members include upper support edges lying within a common support plane.

19. The invention of claim 1 wherein the conformable material is an aluminum alloy.

* * * * *